US008978578B2

(12) United States Patent
Jittu

(10) Patent No.: US 8,978,578 B2
(45) Date of Patent: Mar. 17, 2015

(54) POWDER DELIVERY APPARATUS

(76) Inventor: Alexander I. Jittu, Chesterfield, MI (US)

( * ) Notice: Subject to any disclaimer, the term of this patent is extended or adjusted under 35 U.S.C. 154(b) by 191 days.

(21) Appl. No.: 13/368,789

(22) Filed: Feb. 8, 2012

(65) Prior Publication Data

US 2013/0105000 A1 May 2, 2013

Related U.S. Application Data

(60) Provisional application No. 61/552,146, filed on Oct. 27, 2011.

(51) Int. Cl.

| | |
|---|---|
| ***B05C 19/00*** | (2006.01) |
| ***B05B 7/06*** | (2006.01) |
| ***B05B 7/04*** | (2006.01) |
| ***B05B 7/14*** | (2006.01) |
| ***B01F 13/10*** | (2006.01) |
| ***B05B 12/14*** | (2006.01) |
| ***B05B 15/12*** | (2006.01) |
| *B05B 13/04* | (2006.01) |

(52) U.S. Cl.

CPC ..... *B05B 7/1472* (2013.01); *B01F 13/1002* (2013.01); *B01F 13/1055* (2013.01); *B05B 12/1418* (2013.01); *B05B 12/1472* (2013.01); *B05B 12/149* (2013.01); *B05B 13/0452* (2013.01); *B05B 15/1229* (2013.01); *B05B 15/1292* (2013.01)

USPC ..... 118/308; 118/313; 118/315; 406/156; 406/181; 239/302; 239/304; 239/398

(58) Field of Classification Search

CPC ..... B01F 13/1002; B05C 19/00

USPC ..... 118/308, 309, 313, 315, 692, 684; 406/104, 120, 156, 181, 155, 1–3; 239/302, 304; 137/312, 565.29

See application file for complete search history.

(56) References Cited

U.S. PATENT DOCUMENTS

| | | | | |
|---|---|---|---|---|
| 6,361,605 | B1 | 3/2002 | Shutic et al. | |
| 6,945,470 | B2 | 9/2005 | Kia et al. | |
| 7,273,339 | B2 | 9/2007 | Johnson et al. | |
| 2005/0158187 | A1 | 7/2005 | Fulkerson et al. | |
| 2005/0207901 | A1 | 9/2005 | Klobucar et al. | |
| 2007/0295836 | A1 | 12/2007 | Jittu | |
| 2010/0212589 | A1 * | 8/2010 | Mauchle et al. | 118/694 |

* cited by examiner

*Primary Examiner* — Yewebdar Tadesse

(74) *Attorney, Agent, or Firm* — Young Basile Hanlon & MacFarlane, P.C.

(57) ABSTRACT

A powder delivery apparatus for transporting powder from one or more hoppers to one or more powder applicators. A cross feed network of multi-directional valves and fluid connections is interposed between transfer pumps coupled to the outlets of the hoppers to provide alternately selectable flow paths for the powder from each hopper to selected one of the powder applicators.

14 Claims, 11 Drawing Sheets

POWDER DELIVERY APPARATUS

CROSS REFERENCE TO CO-PENDING APPLICATION

The present application claims priority benefit to the Oct. 27, 2011 filing date of provisional patent application, Ser. No. 61/552,146 for POWDER DELIVERY APPARATUS filed in the name of Alexander I. Jittu, the contents of which are incorporated herein in its entirety.

BACKGROUND

The present invention relates, in general, to powder paint delivery apparatus and methods.

Paint coatings are typically applied to large objects, such as automotive vehicle bodies, automotive vehicle parts and other objects in a closed paint booth. The automotive bodies or parts to be painted move through the booth in a sequential manner, typically via conveyor.

Paint applicators are disbursed throughout the booth and, are frequently in the form of programmed robotic applicators.

Although liquid spray paint has been frequently employed in the past, current technology is moving to powder paint coating application. In a typical powder paint application, powder from a bag or tote is supplied to at least one virgin powder hopper. A percentage of the output of the virgin hopper is supplied to one or more mix hoppers which also receive reclaimed overspray powder paint from the paint booth in a selected ratio.

The powder paint is transported from the virgin and mix hoppers through a network of multi-directional valves to the paint applicators. A control system controls the position of the multi-directional valves so as to enable 100% virgin powder paint to be supplied to one or more specific paint applicators in the paint booth, and/or 100% mixed powder paint from the one or more mix hoppers to one or more specific paint applicators in the paint booth.

If additional mix hoppers are employed, the ratio of reclaimed powder paint to virgin paint in such mix hoppers can be different from the primary or other mix hopper so that a different mix of virgin and reclaimed powder paint can be supplied to specific applicators in the paint booth.

In dense phase powder paint systems using positive air pressure to transport the powder from the hoppers to the paint applicators, applicator pumps generally have a pump chamber including a gas permeable member. Powder paint is supplied to the chamber along with a fluidizing gas, such as air. The fluidized dense phase powder is then discharged from the pump chamber to a paint applicator for disbursal over the object being painted.

Since paint booths typically employ a large number of separate paint applicators, the complexity of the valve and pump networks used to transport powder paint from virgin and mix hoppers to the individual paint applicators can be complex. This complexity necessarily results in frequent breakdown due to the number of components, the viscosity of the powder being transported through the transport systems which can lead to frequent clogging, etc. Production must be halted to repair any damaged or inoperative component in the powder paint transport system.

It would desirable to provide a powder paint delivery apparatus which addresses these deficiencies.

SUMMARY

An apparatus for paint powder transportation between a first location and an application point includes a first powder hopper with a plurality of individual outlets, a first pair of transfer pumps, one pump coupled to each of the plurality of individual hopper outlets for transferring powder from the hopper in separate powder flow paths, two final dense phase pumps for transferring powder to two application location powder applicators, and a first cross feed network is formed of a plurality of multi-directional valves including a first pair of inlet valves, each coupled to one of the first pair of transfer pumps, and a pair of outlet valves, each coupled to one of the two final dense phase pumps. Each inlet valve has two outlets, each outlet coupled to one inlet of both outlet valves, whereby control of the inlet and outlet valves allows powder to be transferred from the hopper by either of the first and second transfer pumps through the cross feed network to either of the two final feed dense phase pumps.

In another aspect, a second pair of transfer pumps are provided with each second pump coupled to one of a plurality of individual first hopper outlets. The second pair of transfer pump is coupled to one of the multi-directional inlet valves of the cross feed network.

In another aspect, the apparatus further include, a second pair of final feed dense phase pumps at the application location which are coupled to individual powder applicators. Separate outlets of the cross-feed network are coupled to multi-directional valves in turn coupled to each of the second pair of final feed dense phase pumps such that control of the multi-directional valve selects one of each of the second pair of final feed dense phase pumps to deliver powder to one applicator.

In one aspect, the first powder hopper is a virgin powder hopper.

In another aspect, the first powder hopper is a mix hopper containing virgin powder and reclaimed powder.

In one aspect, the apparatus further includes a second powder hopper, another first pair of transfer pumps coupled to one of a plurality of individual second hopper outlets for transferring powder from the second hopper in separate powder flow paths, and a separate pair of final feed dense phase pumps. A second cross feed network is formed of a plurality of multi-directional valves including a first pair of inlet valves, each coupled to one of the another first pair of transfer pumps, a pair of outlet valves, each coupled to one of the another two final feed dense phase pumps. Each inlet valve has two outlets, each outlet coupled to one inlet of both outlet valves, whereby control of the inlet and outlet valves allows powder to be transferred from the second hopper to either of the first and second pairs of transfer pumps through the first and second cross feed networks to either of the final dense phase pumps.

The apparatus in the latter aspect includes a first group of powder applicators; a second group of powder applicators; and a plurality of multi-directional valves coupled between the outlets of the first and second cross feed networks and the first and second groups of powder applicators to provide powder from each of the first and second hoppers to at least one applicator in each of the first and second groups of applicators In the latter aspect, the first hopper contains virgin powder; and the second hopper contains a mixture of virgin powder and reclaimed powder.

In the latter aspect, each of the first and second groups of applicators includes at least three separate applicators.

In this apparatus, multi-directional valves are coupled to the outlet of the outlet valves of each of the first and second cross feed networks and each of the three separate applicators in one of the first and second groups of applicators.

In one aspect, the apparatus includes each separate applicator having at least one final feed dense phase pump.

In another aspect, the apparatus further comprises at least one separate applicator including a pair of applicators. Multi-directional valves are coupled to each pair of the pair of applicators to selectively control the transport of powder to either pump of the pair of pumps.

In one aspect, the apparatus includes a third powder hopper, and a third pair of transfer pumps, each coupled to one of a plurality of individual third hopper outlets for transferring powder from the third hopper in separate flow paths. A third pair of transfer pumps has each pump coupled to one of a plurality of individual third hopper outlets. The third pair of transfer pumps are coupled to one of the multi-directional inlet valves of a third cross feed network.

In one aspect, the apparatus includes a plurality of powder hoppers, a plurality of transfer pumps coupled to each of a plurality of hopper outlets for transferring powder from each hopper in separate flow paths, separate cross-feed powder flow networks fluidically coupled to the outlets of each hopper, each separate cross feed network having a plurality of outlets, and valves coupled to the outlets of each of the plurality of cross feed network outlets for selectively delivering powder from each outlet of each of the plurality of hoppers to each of the plurality of application points.

In another aspect, a liquid paint overspray collection apparatus includes a collection tray located in a paint booth to collect paint overspray which did not adhere to an article being painted in the paint booth. A layer of lime is replaceably disposed in the collection tray for coagulating contact with the paint overspray, and means for discharging lime particles coated with paint overspray from the collection tray to a collection hopper.

BRIEF DESCRIPTION OF THE DRAWING

The various features, advantages and other uses of the present powder delivery apparatus and method will become more apparent by referring to the following detailed description and drawing in which.

DETAILED DESCRIPTION

Figure 1:
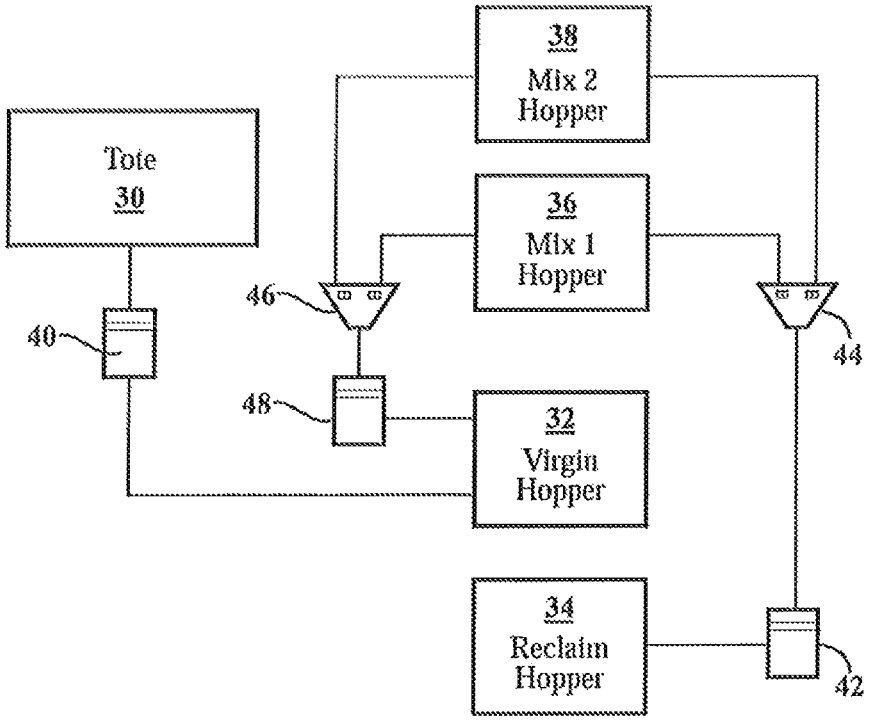
FIG. 1 is a schematic diagram of one aspect of a powder delivery apparatus.

An apparatus and, more particularly, a powder paint delivery apparatus, uses a positive pressure, airflow powder pump 40 to transfer powder, such as paint powder, from a bulk powder supply bag or tote 30 to a virgin hopper 32 containing pure virgin powder.

Since paint booths typically employ a large number of separate paint applicators, the complexity of the valve and pump network.

A reclaim powder hopper 34 collects reclaim powder from a paint delivery booth or area, as described hereafter. A positive pressure pump 42 transfers reclaimed powder from the reclaim hopper 34 through a two way multi-directional valve 44 to at least one and, for example only, two mixer hoppers 36 and 38, hereafter referred to as mix 1 hopper 36 and mix 2 hopper 38. The mix 1 and mix 2 hoppers 36 and 38 serve as temporary storage for reclaimed powder and virgin powder, which is transferred through a two-way multidirectional valve 46 by a positive pressure pump 48 from the virgin hopper 36 to either mix 1 or mix 2 hopper 36 and 38.

Figure 10:
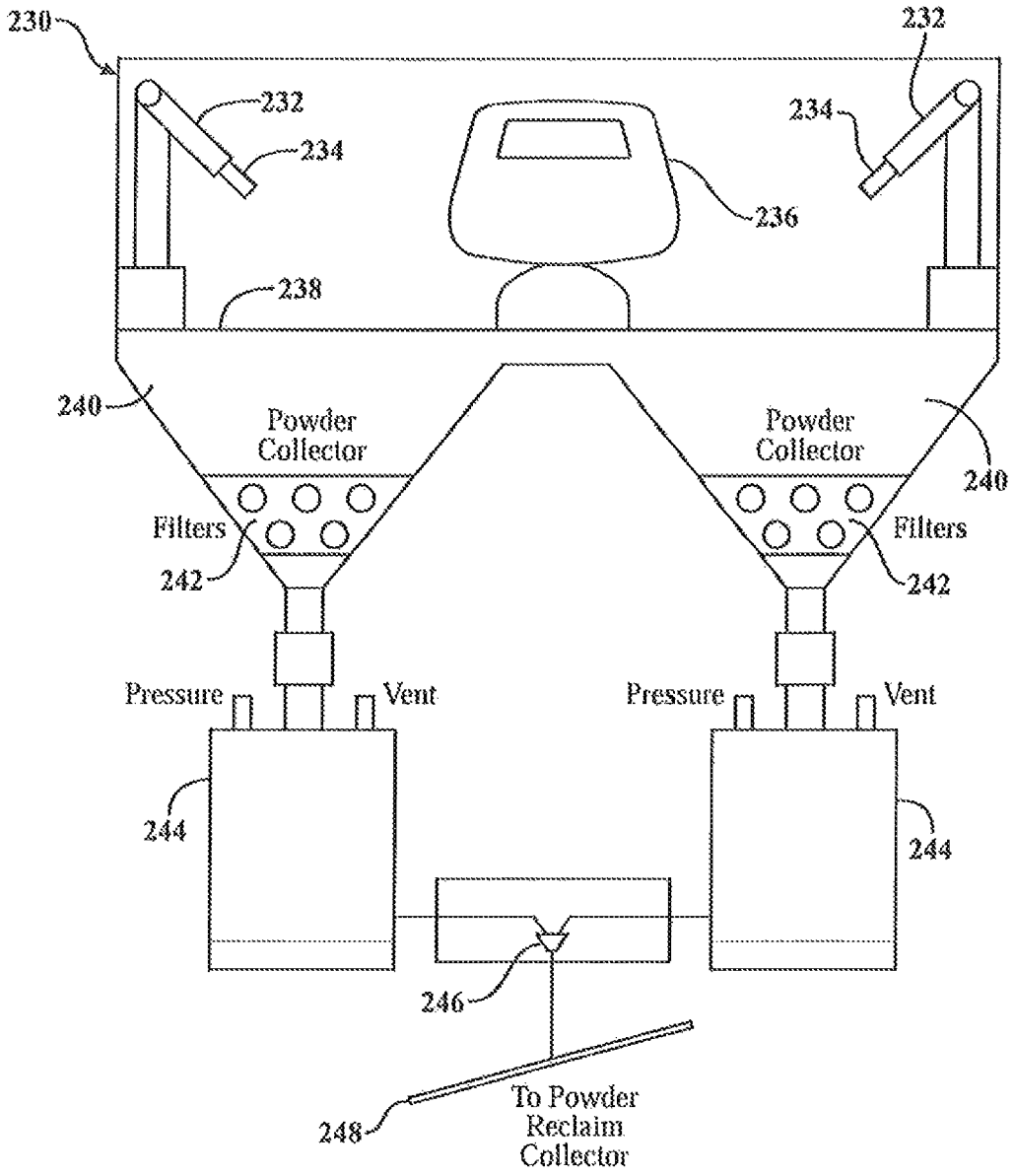
FIG. 10 is a pictorial representation of a typical automotive body paint booth with a reclaim powder collection system and pump apparatus.

As shown in the powder paint deliver booth depicted in FIG. 10, powder paint is delivered to opposite sides of the booth for application to opposite sides of an article, such as a vehicle body. The powder paint delivery devices on either side of the paint booth are referred to generally as left side automation and right side automation.

Figure 2:
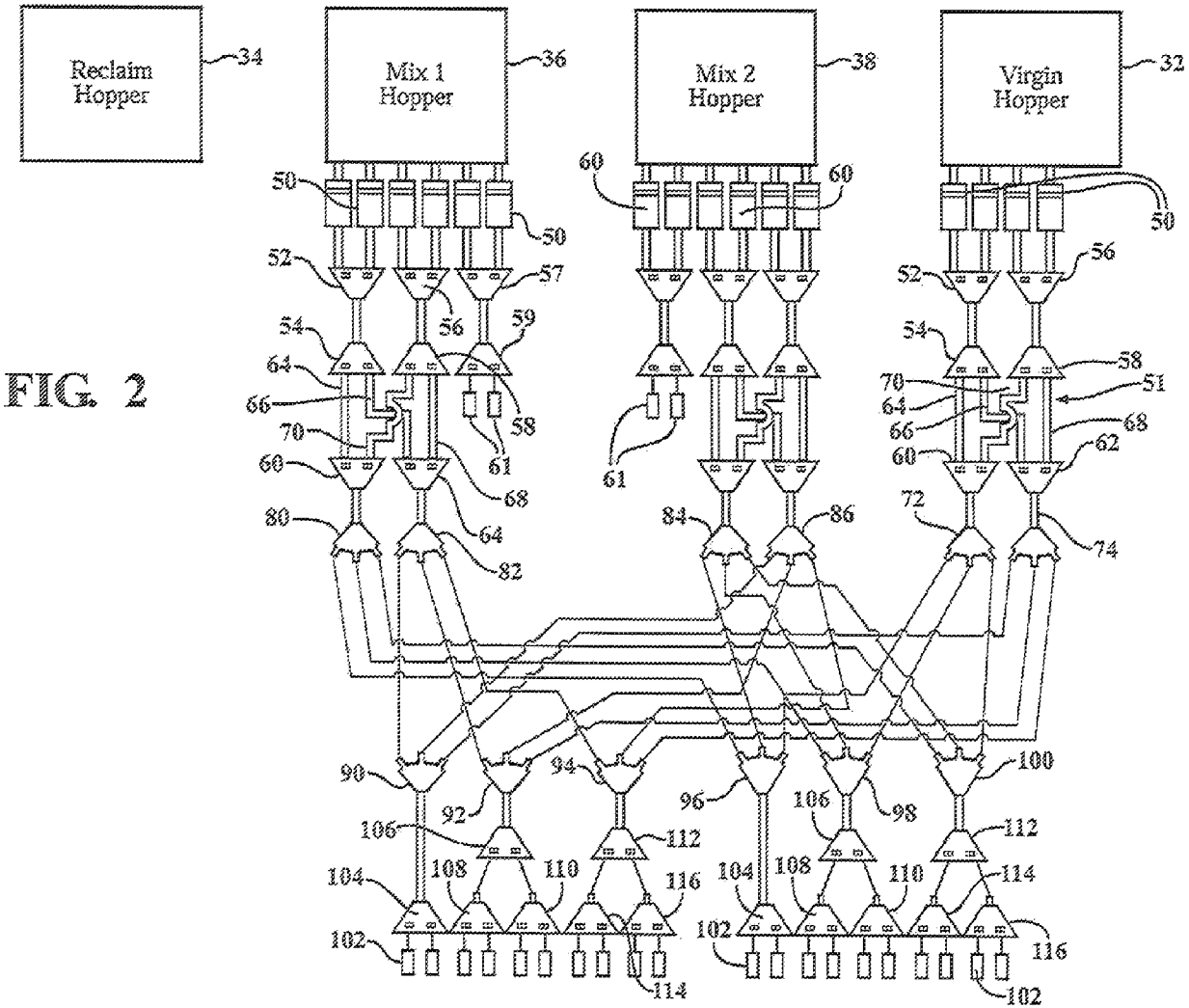
FIG. 2 is a schematic diagram of one aspect of the transport network used to transport powder from the hopper shown in FIG. 1 to paint applicator.

As shown in FIG. 2, a plurality of positive pressure air flow powder pumps 50 are connected to individual, separate outlets of the virgin hopper 32. By way of example, four pumps 50 are connected to individual outlets of the virgin hopper 32. Each pump 50 can be paired with another pump 50 to form two positive pressure powder flow paths from the virgin hopper 32. The outlets of each pair of pumps 50 are coupled through a two-way multi-directional valve 52 to a reverse oriented two-way multi-directional valve 54. A second pair of pumps 50 are coupled to the inlets of a two way multi-directional valve 56. The outlet of the valve 56 is coupled to the inlet of a two-way multi-directional valve 58.

The multi-directional valves 54 and 58 form a pair of inlet valves of a cross feed network 51 which also includes a pair of outlet valves 60 and 62 and cross feed fluid connections or conduits extending between the two outlets on each of the inlet valves 54 and 58 and the two inlets of each of the outlet valves 60 and 62.

One flow path extends directly from one outlet of the valve 54 to one inlet of the valve 60. A second flow path 66 is coupled between the second outlet of the valve 54 and one inlet of valve 62.

Similarly, a flow path 68 extends directly between one outlet of the valve 58 and one inlet of the valve 62. A cross feed flow path 70 is formed between the other outlet of the valve 58 and the second inlet of the valve 60. The outlet of the valve 60 is coupled to the inlet of a three way multi-directional valve 72. Similarly, the outlet of valve 62 is coupled to the inlet of another three-way multi-directional valve 74.

As shown in FIG. 1 and described above, the mix 1 and 2 hoppers 36 and 38 have an inlet from the two-way valve 44 to receive reclaimed powder from the reclaim hopper 34 via pump 42. Another inlet to the mix 1 and 2 hoppers 36 and 38 receives virgin powder from the virgin hopper 32 via two-way valve 46 and pump 48. This enables the output of the virgin hopper 32, as described above and shown in FIG. 2, to selectively be 100% virgin powder only or a mixture of virgin powder and reclaimed powder, such as a mixture of 90% virgin powder and 10% reclaimed and virgin powder from the mix 1 and 2 hoppers 36 and 38.

Each mix 1 and 2 hopper 36 and 38, as shown in FIG. 2, has outlets for supplying reclaimed powder from the reclaim hopper 34 mixed with virgin powder from the virgin hopper 32 directly to the paint area. The virgin hopper 32, as also shown in FIG. 2, has additional outlets for directly supplying 100% virgin powder directly to the paint area, without any mixing with reclaimed powder.

Since the following pumps and valves have the same arrangement and serve the same function as the pumps and valves 50-74 shown in FIG. 2 for the virgin hopper 32, like parts are given like reference numbers. Thus, at least one pair, and, for example, a plurality of pairs of positive pressure transfer pumps 50 are coupled to individual outlets of the mix 1 hopper 36. The pumps 50 are arranged in pairs, with each pair of pumps 50 connected to separate outlets of the mix 1 hopper 36. Each associated pair of pumps 50 is coupled to an inlet of a two-way multidirectional valve 52 or 56. The valves 52 and 56 are coupled to two-way inlet valves 54 and 58 and form part of a cross-fee network 53 along with a cross feed fluid flow connections or fluid passageways 64, 66, 68 and 70. The cross feed fluid flow network feeds outlet valves 60 and 62 which are coupled with fluid communication with three-way multi-directional valves 80 and 82, respectively.

Another pair of pumps 50 are coupled to individual outlets of the mix 1 hopper 36. Each pump of this pair of pumps 50 is coupled to two-way valves 57 and 59. The two outlets of the valve 59 are coupled through positive pressure pumps 61 to individual powder delivery guns or nozzles, labeled "sill guns 61" by way of example only in FIG. 2.

Similar arrangement of separate outlet flow paths and a cross feed network is provided from the mix 2 hopper 38 and three-way valves 84 and 86.

A plurality of three-way valves, with six three-way valves 90, 92, 94, 96, 98, and 100 are arranged to receive selected outputs from the three-way valves 72, 74, 80, 82, 84 and 86 to supply powder to the left side and right side automation powder delivery devices or paint guns in one example.

The three-way valves 90, 92, 94, 96, phase, 98 and 100 allow multiple flow paths for powder to be delivered through a plurality of final feed dense phase delivery pumps, all denoted by reference number 102, from selected ones of the outlets of the virgin hopper 32 and the mix 1 and mix 2 hoppers 36 and 38.

Thus, the three outlets of three-way valve 72, which receive powder from the virgin hopper 32, are connected to three-way valves 96, 98, and 100 to feed the selected output devices on the right side automation. The opposed three-way valve 74 is coupled to receive powder from the virgin hopper 32 and feeds individual valves 90, 92, and 94.

Similarly, the right side three-way valve 80 is coupled to receive powder from the mix 1 hopper 36 and has three outlets respectively coupled to the three-way valves 96, 98 and 100. The right side three-way valve 84 coupled to the mix 2 hopper 38 likewise has three outlets respectively coupled to the valves 96, 98, and 100. Similarly, for the left side automation, valves 74 coupled to the virgin hopper 32 has three outlets individually, respectively coupled to the valves 90, 92, and 94. The left side valve 82 coupled to the mix 1 hopper 36 has 3 outlets respectively coupled to individual inlets on the valves 90, 92, and 94. Similarly, the left side valve 86 coupled to the mix 2 hopper 38 has three outlets respectively coupled to the valves 90, 92, and 94.

By way of example, the three-way valves 90 and 96 are directly coupled to separate two-way valves 104. The two-way valves 104 are coupled to two final feed dense phase delivery pumps 102.

The single outlet of each three-way valve 92 and 98 is coupled through an individual two-way valve 106. The two outlets of the two-way valves 106 are coupled to individual two-way valves 108 and 110, each of which is coupled to two pairs of final feed dense phase delivery pumps 102.

Similarly, the three-way valves 94 and 100 have a single outlet coupled to an inlet of individual two-way valves 112. The two outlets of the valve 112 are coupled to inlets of additional two-way valves 114 and 116, each of which is fluidically coupled to a pair of final feed dense phase pumps 102.

The above-described powder flow arrangement allows any mixture of virgin powder, mix 1 hopper powder or mix 2 hopper 38 powder to be supplied through the final feed dense phase delivery pumps 102 to the powder applicator devices in the paint booth. A portion of the powder in the mix hoppers 36 and 38 also can be supplied to sill guns via sill gun transfer pumps 61.

Thus, for example, virgin powder from the virgin hopper 32 may be independently supplied to each of the left side automation and right side automation powder applicator devices. The virgin powder may also be mixed with reclaim powder in either or both of the mix 1 hoppers 36 and 38 for transfer by the final feed dense phase delivery pumps 102 to the application points.

Reclaim powder in the mix 1 hopper 36 may also be supplied independently of powder in the mix 2 hopper 38 virgin powder from the virgin powder hopper 32 to the application points via the final feed dense phase delivery pumps 102. Similarly, reclaim powder in the mix 2 hopper 38 may be supplied exclusively to the applicant points via the final feed dense phase delivery 102 without mixing with any powder from the mix 1 hopper 36 or the virgin hopper 32.

The use of a pair of pumps coupled to individual outlets of each of the virgin hopper 32, the mix 1 hopper 36 and the mix 2 hopper 38 allows multiple powder supply paths from the hoppers 32, 36 and 38. This enables a continuous transfer of powder from the hoppers 32, 36, and 38 even if one of the outlets is clogged and inoperative or if one of the transfer pumps 50 breaks down or is otherwise inoperative.

The cross feed network formed of valves 54, 58 60 and 64 and the cross feed flows path 64, 66, 68 and 70 allow powder from multiple transfer pumps 50 associated with each hopper 32, 36 and 38 to be supplied to either the left side or right side automation. This allows powder to be supplied continuously to the application points despite any breakdown in a single flow path or one of the pumps or valves in any flow path.

Previously, powder in such applications was delivered exclusively to the left side automation or the right side automation. A breakdown of the powder transfer apparatus on one side of the article being painted could lead to a total shut down of the production line since powder could only be supplied to one side of the article and not simultaneously to both sides. The cross feed network allows powder, in any mixture of virgin and reclaimed powder, to be supplied simultaneously to both of the left side and right side automation powder delivery paths and selectivity between flow paths to overcome any break down of equipment.

Figure 3:
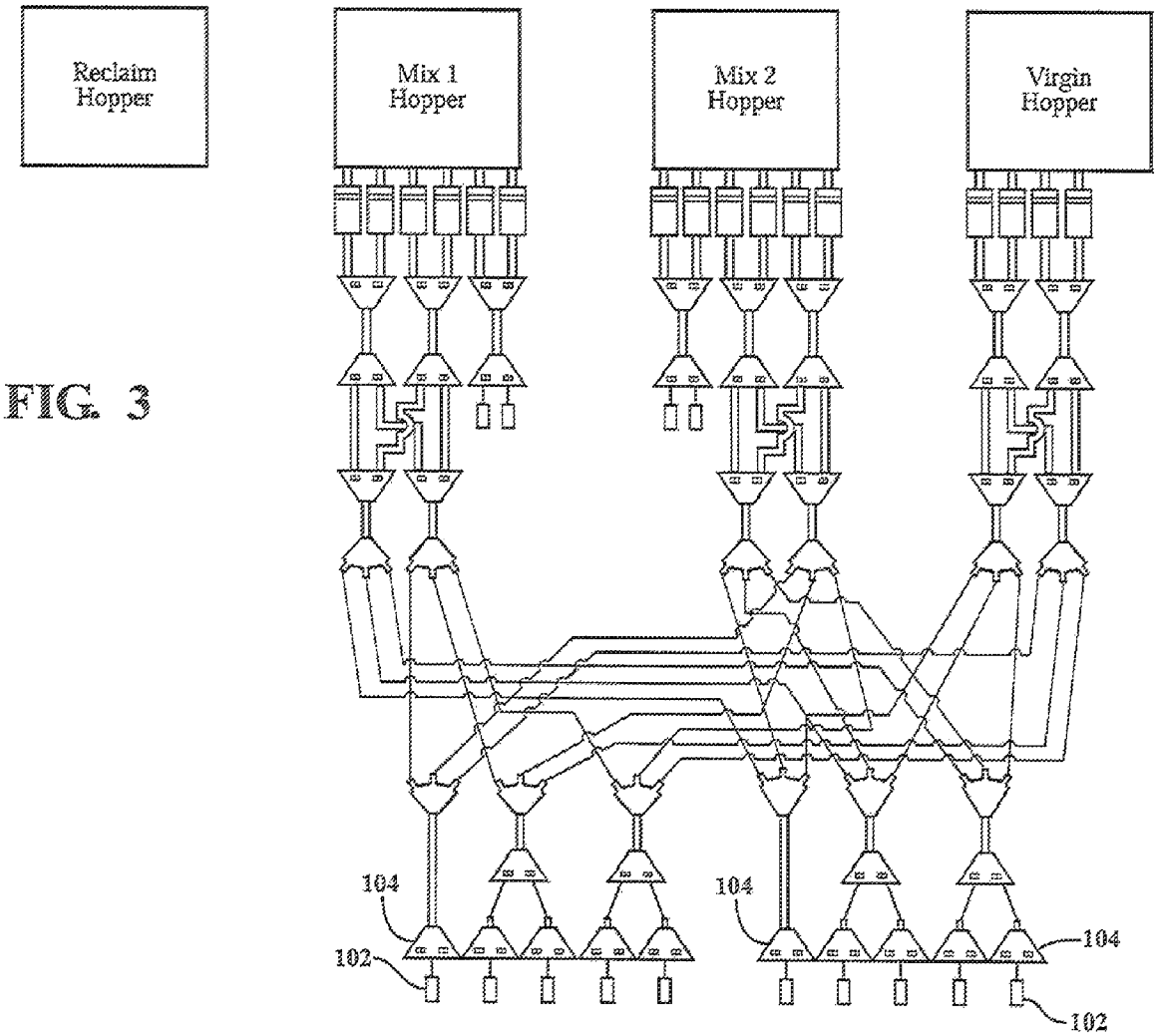
FIG. 3 is a schematic diagram of another aspect of one aspect of the transport network used to transport powder from the hopper shown in FIG. 1 to paint applicator.

FIG. 3 depicts a powder delivery apparatus which is substantially identical to the apparatus described above and shown in FIG. 2. The only difference between the powder delivery apparatus shown in FIGS. 2 and 3 is that the apparatus shown in FIG. 3 has only a single final feed dense phase delivery pump 102 coupled to each discharge two-way valve 104, rather than the separate pairs of final feed dense phase delivery pumps 102 shown in FIG. 2.

Figure 15:
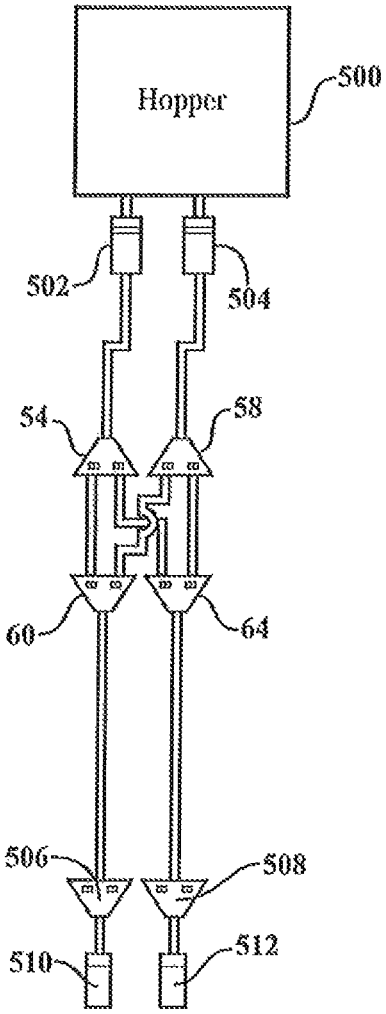
FIG. 15 is a schematic diagram of another aspect of the powder delivery apparatus.

Referring now to FIG. 15, there is depicted another example of a powder delivery apparatus based on the principles of the powder delivery apparatus shown in FIGS. 2 and 3 and described above. A hopper 500 can function as a hopper for either virgin powder, or as a mix hopper for a predetermined percentage of virgin and reclaimed powder. Two pumps 502 and 504 attached to separate discharge outlets of the hopper 500 and individually supply powder from the hopper 500 to separate inputs in the cross feed network formed of valves 54, 58, 60 and 64 and cross connected fluid connections as described above and shown in FIGS. 2 and 3.

The single outputs from the valves 60 and 62 are coupled through a multi-directional valve 506 and 508, respectively, to individual single final feed dense phase pumps 510 and 512, respectively. It will be understood that the use of the multi-position or direction valves 506 and 508 is optional.

Figure 16:
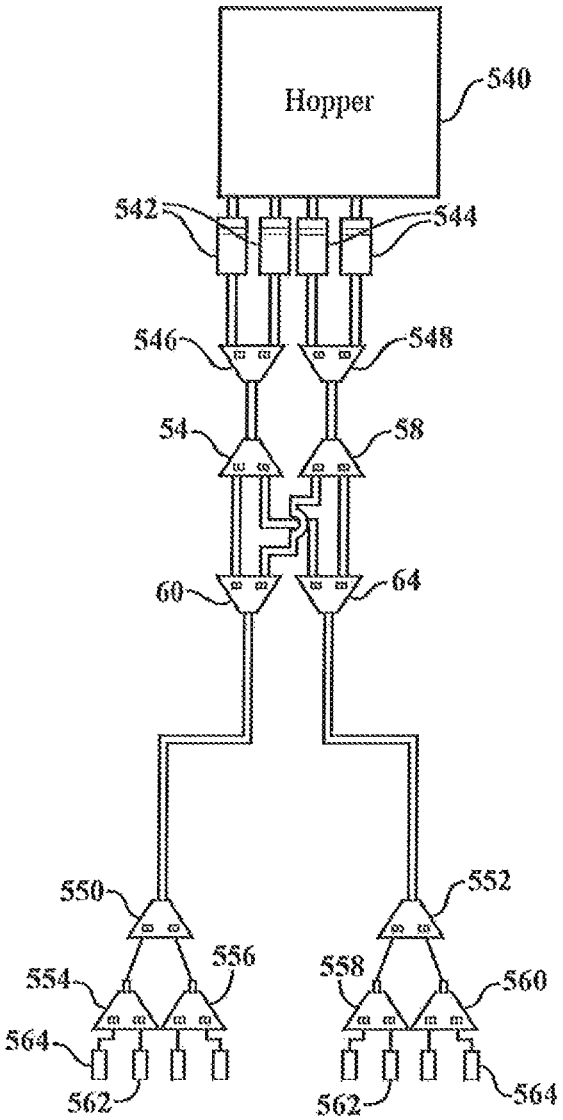
FIG. 16 is a schematic diagram of yet another aspect of the powder deliver apparatus.

FIG. 16 depicts a similar example of a powder delivery apparatus. In this aspect, powder supplied to the hopper 540 may again be virgin powder or a mixture of virgin and reclaimed powder. Further, in this aspect, pairs of delivery pumps 542 and 544 are connected to separate discharge outlets in the hopper 540. The outlets of the pumps 542 are supplied to separate inputs of a multi-directional valve 546, the output of which is coupled to the input of inlet valve 54 of a cross feed network.

The outputs of the other pair of pumps 544 are connected to the inputs of a multi-positional valve 548. The single output of the valve 548 is coupled to the input of valve 58 of the cross feed network formed of valves 54, 58, 60 and 64 and fluid conduits.

The output of the cross feed network, namely, the separate outputs of valves 60 and 64, are respectively supplied to multi-direction valves 550 and 552. The separate outputs from each valve 550 and 552 are coupled to inputs of two multi-direction valves, such as valves 554 and 556 for the valve 550, and valves 558 and 560 for the valve 552.

The output or outputs of each valve 554, 556, 558 and 560 may supply powder to at least one final feed dense phase pump 562 or a pair of final feed dense phase pumps, including additional pumps 564.

In this latter aspect, inoperability, breakdown or clogging of any one line in the powder transport network between the hopper 540 and any of the pumps 562 and 564 may be overcome by switching any of the valves 546, 548, 550, 552, 554, 556, 558 and 560 as well the individual valves 54, 58, 60 and 64 in a cross feed network to alter the route that powder from the hopper 540 is delivered to a particular pump 562 or 564.

Figure 17:
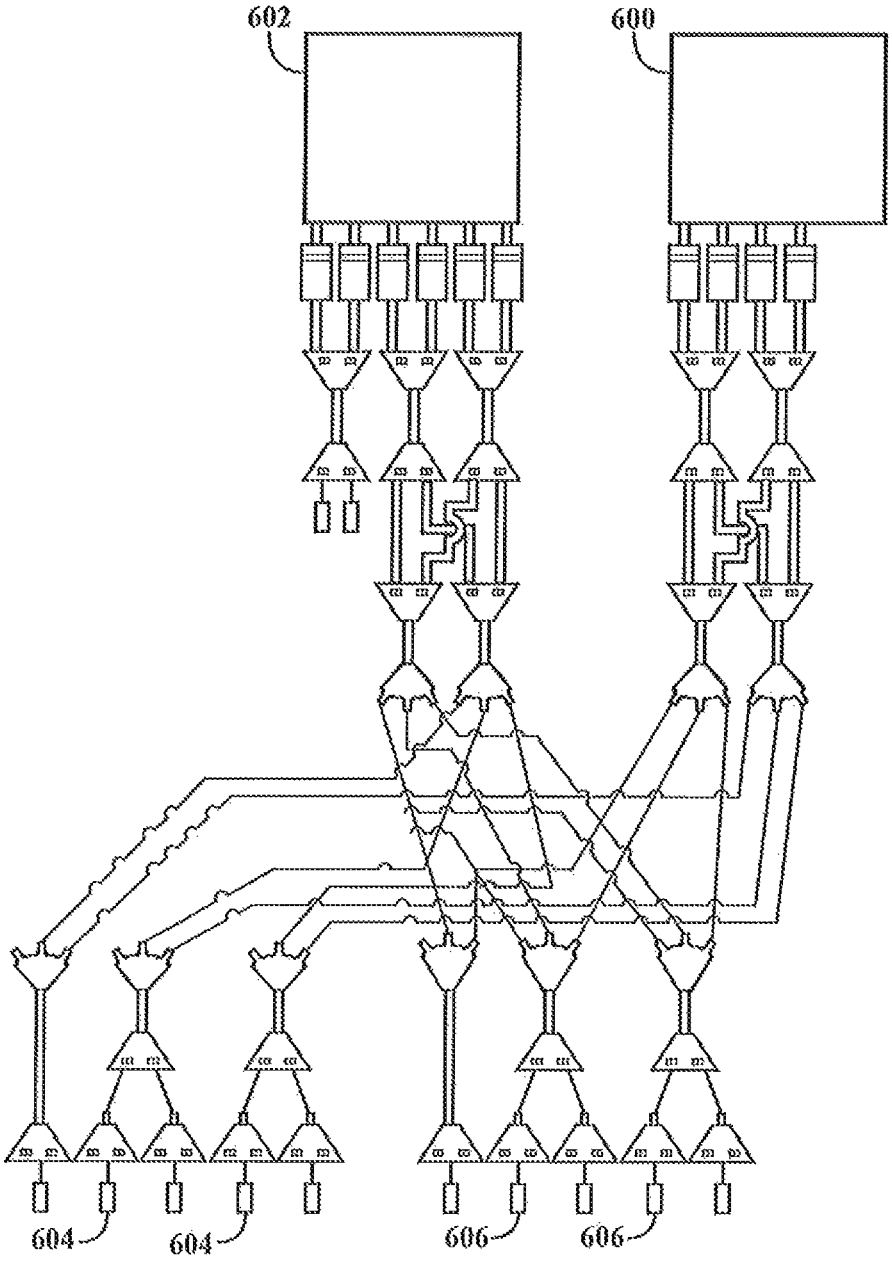
FIG. 17 is a schematic diagram of another aspect of a powder delivery apparatus.

FIG. 17 depicts another aspect of a powder delivery apparatus which is similar to the apparatus depicted in FIG. 3, but only includes two hoppers. One of the hoppers, such as hopper 600, may be supplied with virgin powder. The other hopper 602 may be supplied with a mixture of reclaim powder and virgin powder.

As the pump and valve networks used to transport powder from the hopper 600 and 602 to a plurality groups of pumps, respectively denoted by reference numbers 604 and 606, as the same as that depicted in FIG. 3, the description of the powder delivery network shown in FIG. 3 and described above will be understood to apply equally to the powder delivery network shown in FIG. 17.

Figure 4:
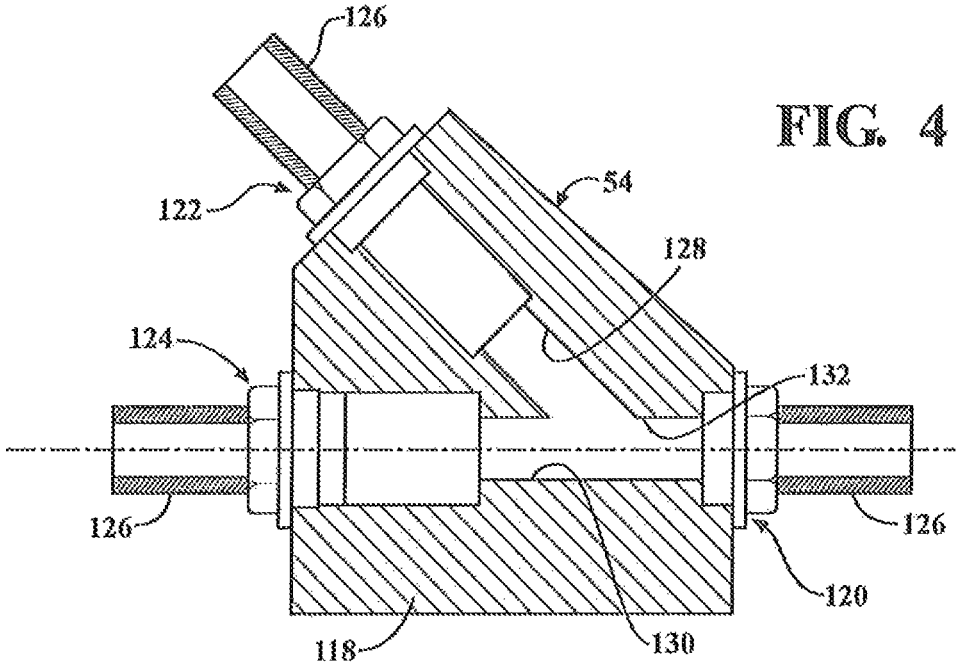
FIGS. 4 and 5 are cross-sectional views of different multi-directional valve employed in the powder transport network shown in FIGS. 2 and 3.

The details of one example of a two-way multi-directional valve, such as two-way valve 54, is shown in FIG. 4. The two-way multidirectional valve 54 includes a body with separate conduit connections including first, second and third connections 120, 122, and 124. The fluid connections allow a conduit representatively shown by reference number 126 to be fluidically coupled to the body 118 of the valve 54.

The two-way valve 54 is multidirectional in that the conduit 126 may serve as a single inlet or a singlet outlet for the valve 54. Likewise, the pairs of conduits 126 coupled to connections 122 and 124 may serve as a pair of outlets or a pair of inlets depending upon how the valve 54 is coupled in the powder flow path. The conduits 126 coupled to the valve body 118 via the connections 122 and 124 have bores 128 and 130, respectively, which merge within the interior of the valve body 118 into a single bore 132 leading through the conduit connection 120.

Figure 5:
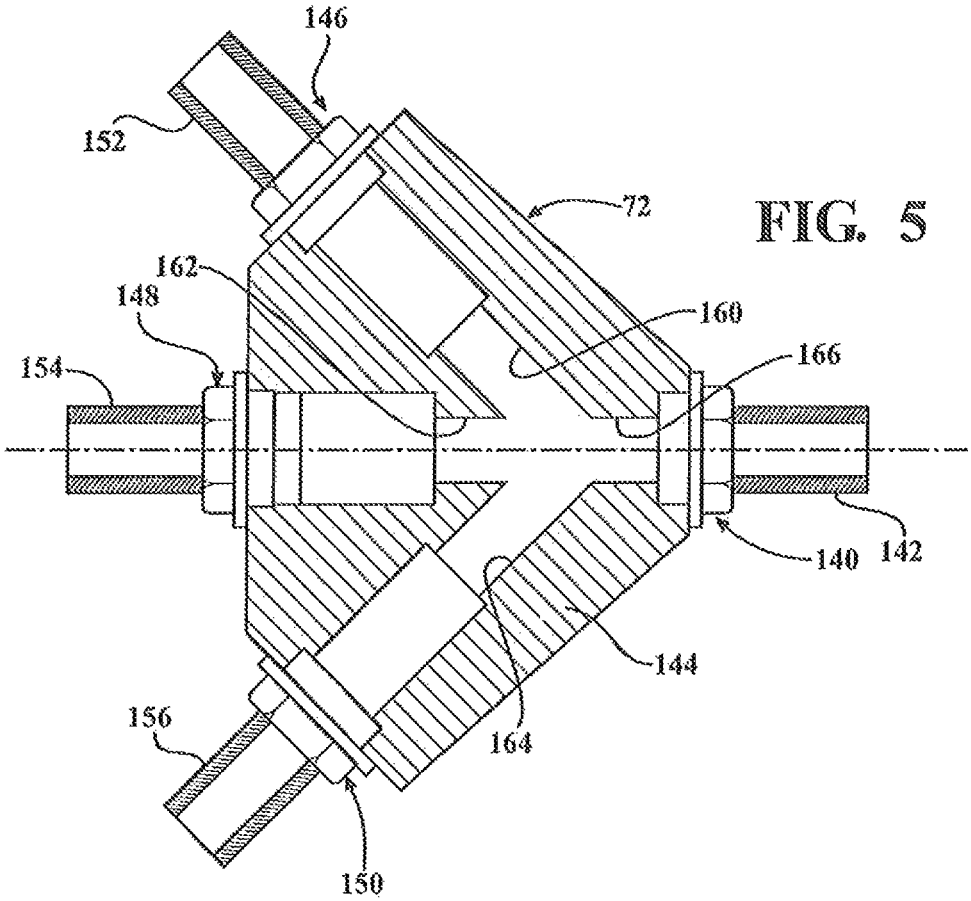

An example of a three-way multi directional valve, such as valve 72, is shown in FIG. 5. The three-way valve 72 has a construction similar to the two-way valve 54 in that a first connection 140 allows a first conduit 142 to be coupled to the body 144 of the valve 72. Three separate connections 146, 148 and 150 allow connection of individual conduits 152, 154, and 156, respectively, to the valve body 144. Each conduit 152, 154, and 156 is respectively disposed in fluid flow communication with an interior bore 160, 162, and 164. The bores 160, 162, and 164 merge into a single bore 166 leading to the single connection 140.

In both of the two-way and three-way valves 54 and 72, for example, pneumatically actuated pinch valves, not shown, are mounted in each inlet and outlet coupling to control the flow of powder through the valve. The pinch valves are controlled by external pneumatic circuitry to enable each valve to direct fluid flow in the desired flow path through the valves 54 and 72.

Figure 6:
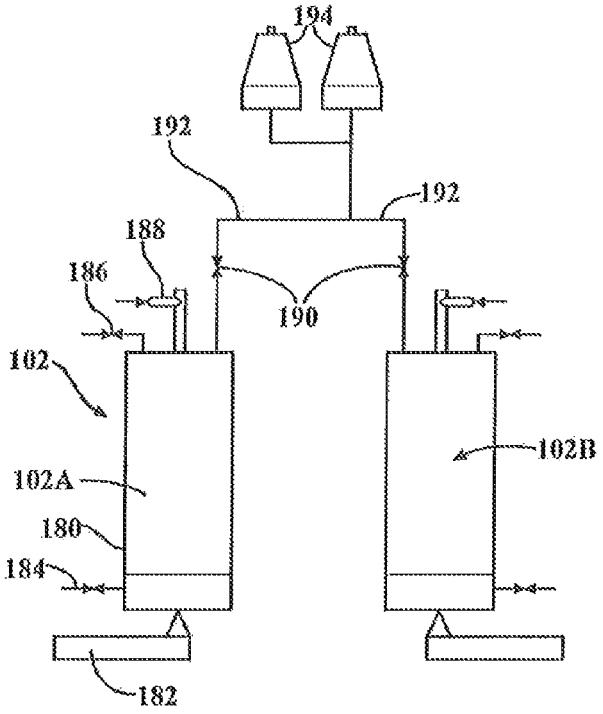
FIG. 6 is a schematic diagram of one aspect of a final feed dense phase delivery pump arrangement.

FIG. 6 depicts one pair of final feed dense phase deliver pumps 102, hereafter referred to separately by reference numbers 102A and 102B, coupled to a single two-way valve 116, as shown in FIG. 2.

Each final feed dense phase delivery pump 102A and 102B is similarly constructed of a hollow body 180. The body 180 rests on a scale 182. A fluidization inlet port 184 is provided for supplying air to the powder within the body 180 to fluidize the powder for consistent volume delivery. A powder support port 186 is coupled to the valve 116 and the body 180 to supply powder to the pump 102A. A vent port 188 with a restriction or pinch valve is provided on the body 180 to prevent pressure build up within the body 180.

A delivery valve 190 is coupled within a discharge path 192 leading from the pump body 180 to one or more such as two powder delivery applicators 194.

It should be noted that the other final feed dense phase delivery pump 102B is identically constructed and has its discharge path 192 coupled in common with a discharge path 192 from the opposite pump 102A. This allows powder to be supplied from either pump 102A or 102B to the powder applicator(s) 194.

For example, the final feed dense phase delivery pump 102A can be active and supplying powder to the applicators 194; while the opposite final feed dense phase delivery pump 102B is inactive or being refilled with powder. Similarly, pump 102B can be active and supplying powder to the applicators 194; while the other pump 102A is inactive or being refilled with powder.

Figure 7:
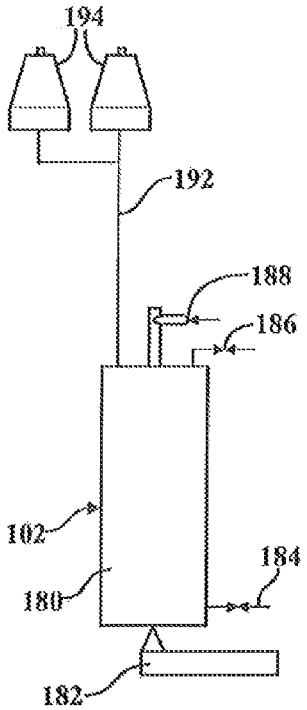
FIG. 7 is a schematic diagram of another aspect of a final feed dense phase delivery pump configuration.

FIG. 7 depicts an example of a single final feed dense phase delivery pump 102 for the single final feed pump aspect of the powder delivery apparatus shown in FIG. 3. As the pump 102 shown in FIG. 7 is identically constructed as the pumps 102A and 102B, the description of the construction and operation of the pump 102A will be understood to apply equally to the pump 102 shown in FIG. 7. The single pump 102 shown in FIG. 7 can be refilled during down time in the production line, between production shifts, between paint application operations, or between two adjacent cars running on the production line.

The use of one or more applicators supplied by a single pump allows dispersion as well as a back up capability in case of clogging or failure of one of the applicators 194.

Figure 8:
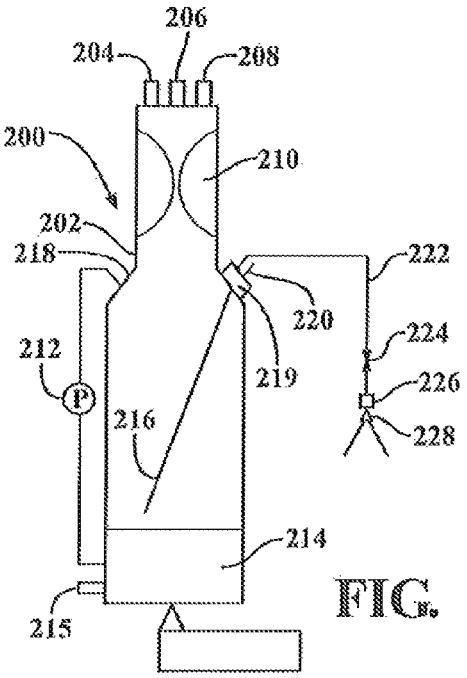
FIG. 8 is a partially cross-sectioned view of a final feed dense phase delivery pump which may be employed for any of the pumps shown in FIGS. 6 and 7.

Referring now to FIG. 8, there is depicted one example of the structure of a final feed dense phase delivery pump 200, which can be employed in any of the pumps 102. The pump 200 has a closed body 202 with a cleaning gas port 204, a powder supply port 206 and a vent port 208 which may be located on the upper end of the body 202. A restriction valve, such as a pinch valve 210, is contained within the body 202 for converting the turbulent flow of the powder delivered through the powder inlet 206 to laminar flow into the interior of the pump body 202. A pressure control 212 is coupled to the body 202 for controlling the pressure of the air within the body 202. A fluidization plate 214 is mounted within the lower portion of the interior of body. The air or gas within the body 202 fluidizes the powder above the plate 214.

A powder pickup tube or conduit 216 is disposed at an angle within the body 202 and extends from above the fluidization plate 216 to an outlet connection on a side portion of the body 202. A vent port 220 is also coupled to the connection 219. The connection 219 provides fluid communication between the powder pickup 216 within the body 202 and an external powder supply conduit 222 which extends from the connection 219 to a trigger valve 224. Dilution air is supplied through a fitting 226 to dilute the powder as it exits an applicator 228.

A fluidization port 215 opens below the fluidization plate 214 to provide fluidization air or gas to the powder within the body 202.

Figure 9:
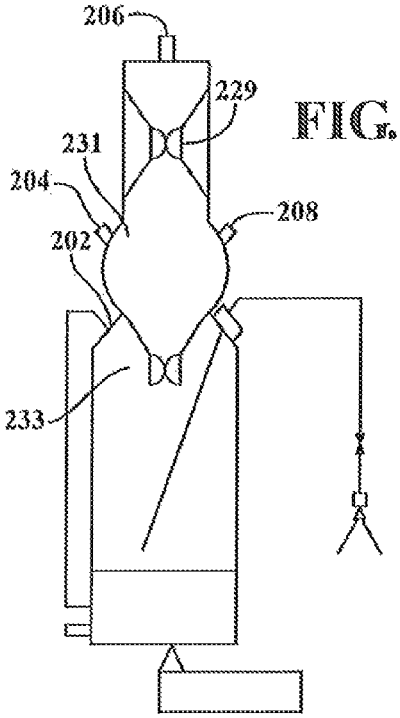
FIG. 9 is a partially cross-sectioned view of another aspect of a final feed dense phase delivery pump which may be employed for any of the pumps shown in FIGS. 6 and 7.

FIG. 9 depicts a modification of the final feed pump shown in FIG. 8. In this aspect of the final feed dense phase delivery pump, the powder supply port 206 is still located on the upper end of the pump body 202. However, in this aspect, a first restrictive valve or pinch valve 229 is located in the upper portion or neck of the pump body 202. The neck of the pump body 202 expands from the narrow upper end into an enlarged chamber 231, which is formed between the first restrictive or pinch valve 229 and a second restrictive or pinch valve 233. The vent port 204 and the cleaning port 208 are coupled in fluid communication with the enlarged chamber 231.

The purpose of the two pinch valves 229 and 231 in this aspect of the final feed pump is to control powder delivery to the body 202 by gradually opening the tightly closed first pinch valve 229. This translates turbulent flow of the powder delivered through the powder inlet port 206 to laminate flow through the second pinch valve 233 as the second pinch valve 233 is opened to allow the powder to flow to the interior of the pump body 202.

FIG. 10 depicts a typical powder paint application in which a closed area, such as a closed paint booth 230, contains multiple robotic devices 232 and/or automatic machines, and/or manual paintwork stations which carry powder applicators 234 for dispensing powder paint onto an article being painted, such as vehicle body 236.

Excess powder that does not adhere to the vehicle body 236 falls through openings in the booth floor 238. Powder collector chambers 240 are located below the booth floor 238. Multiple powder collector chambers 240 may be situated side-by-side along each side of the length of the booth 230. Filters 242 located in a lower portion of the powder collector chambers filter debris from the powder and allow the powder to flow through a pump 244. The pump 244 may be used for any of the pumps 40, 42, 50, etc., described above. The outlets of the left side and right side automation collector pumps 244 are coupled through a two-way multi-directional valve 246 to transfer the reclaimed powder to a powder reclaim collector via conduit 248.

A level sensor, not shown, or a scale can be employed to detect the powder level or quantity of powder within each powder collection chamber 240. Once a predetermined powder level is detected within either powder collector 240, control circuitry activates movement of the filters 242 in a back pulse manner to allow the powder to flow from the powder collector 240 by the pump 244 to the collection hopper.

Figure 11:
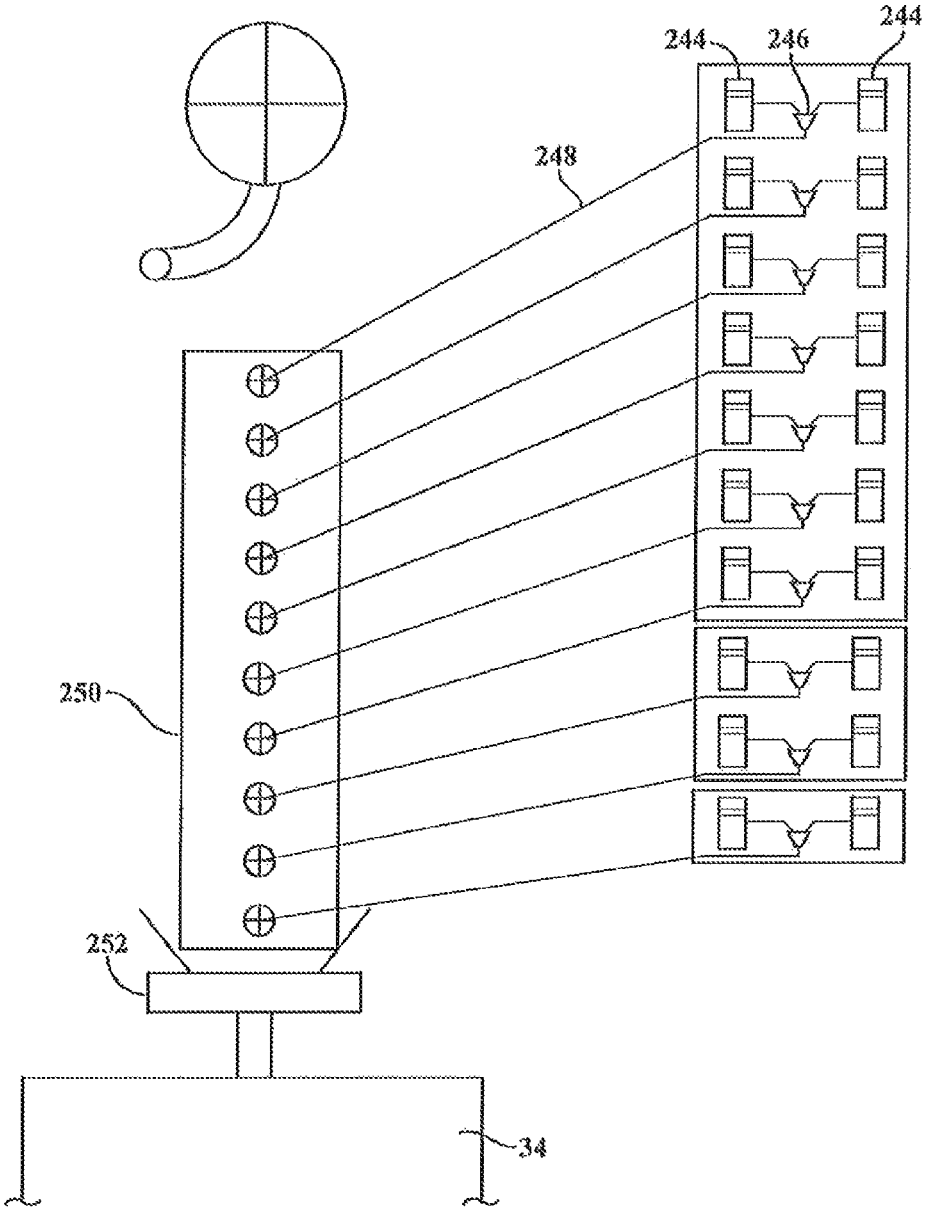
FIG. 11 is an exploded pictorial view of the supply of reclaim powder from the powder reclaim collectors shown in FIG. 10 to a reclaim hopper.

It should be noted that the pair of left and right side pumps 244, the two way valve 246, and the conduit 248 are repeated for each pair of left side and right side powder collectors along the length of the booth 230, as well as any manual paint applicator zones or work stations, and a silenced zone as shown in FIG. 11.

The powder reclaim collector 250 is mounted above the reclaim powder hopper 34 and receives the conduits 248 from each pair of reclaim powder collector pumps 244 and two-way valves 246. The collected powder passes through a powder seive 252 before flowing into the interior of the reclaim hopper 34.

Figure 12A:
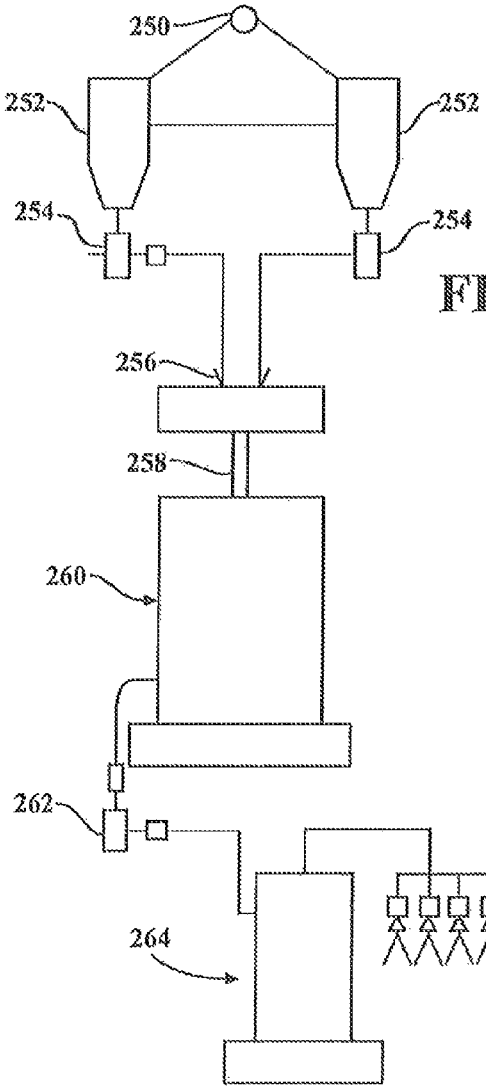
FIG. 12*a* is a schematic and partially cross-sectioned diagram of a micro powder delivery apparatus.

FIG. 12A is a schematic diagram depicting a micro-powder delivery apparatus. In this apparatus, micro powder material 250 is supplied to one or more bulk powder tanks 252. A dense phase powder pump 254 transfers micro-powder from the bulk tanks 252 to a seive 256. A powder conduit tube 258 is coupled between the seive 256 and a micro-powder material hopper 260.

The hopper 260 supplies micro sized powder material through a pump 262 to a final feed pump 264 which can be constructed according to either of the final feed pumps 200 shown in FIG. 8 or 9. The final feed pump 264 supplies powder to one or more powder applicators 266.

Figure 12B:
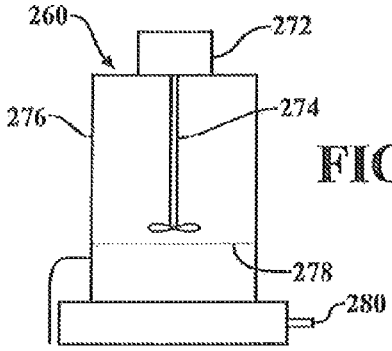
FIG. 12*b* is a partially cross-sectioned view showing a construction of the micro powder material hopper shown in FIG. 12*a;*

An example of the construction of the hopper 260 is shown in FIG. 12B. An electric motor 272 drives an agitator 274 within the interior of the pump body 276. A fluidization plate 278 is located above the bottom of the hopper 260 and below the agitator 274. The hopper 260 may rest on a scale 280.

Figure 13:
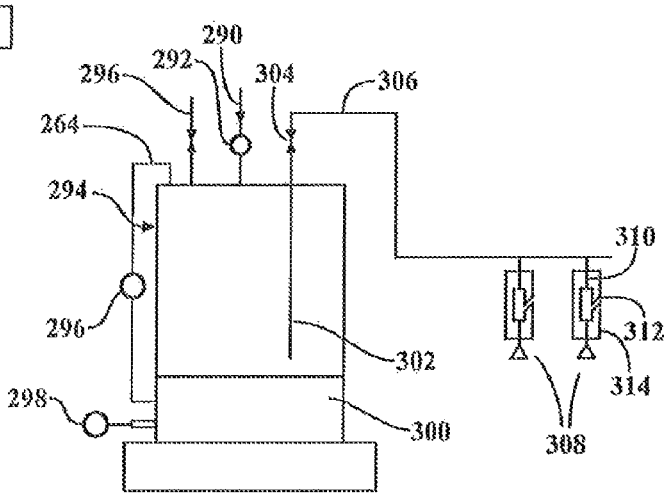
FIG. 13 is a schematic diagram showing the connections to the final feed dense phase pump shown in FIG. 12*a;*

An example of the connections to the final feed dense phase pump 264 depicted in FIG. 12A is shown in FIG. 13. A vent port 290 with a restriction or pinch valve 292 is coupled to an upper end of the pump body 294. A powder supply port 296 is also provided on the upper end of the body 294. A pressure control device 296 is coupled to the interior of the body 294 to control air pressure within the pump body 294. A fluidization port 298 is coupled to a lower portion of the pump body 294 to provide a fluidization air or gas to the powder through a fluidization plate 300 located in bottom portion of pump body 294. A powder delivery tube or conduit 302 exits the body 294 through a delivery valve or trigger 304. A delivery tube 306 extends from the trigger 304 to one or more powder delivery applicators 308. Each applicator 308, as shown from one of the applicator's 308 can include a recovery valve 310, a multicolor dilution port 312 and the powder delivery applicator itself 314.

Figure 14:
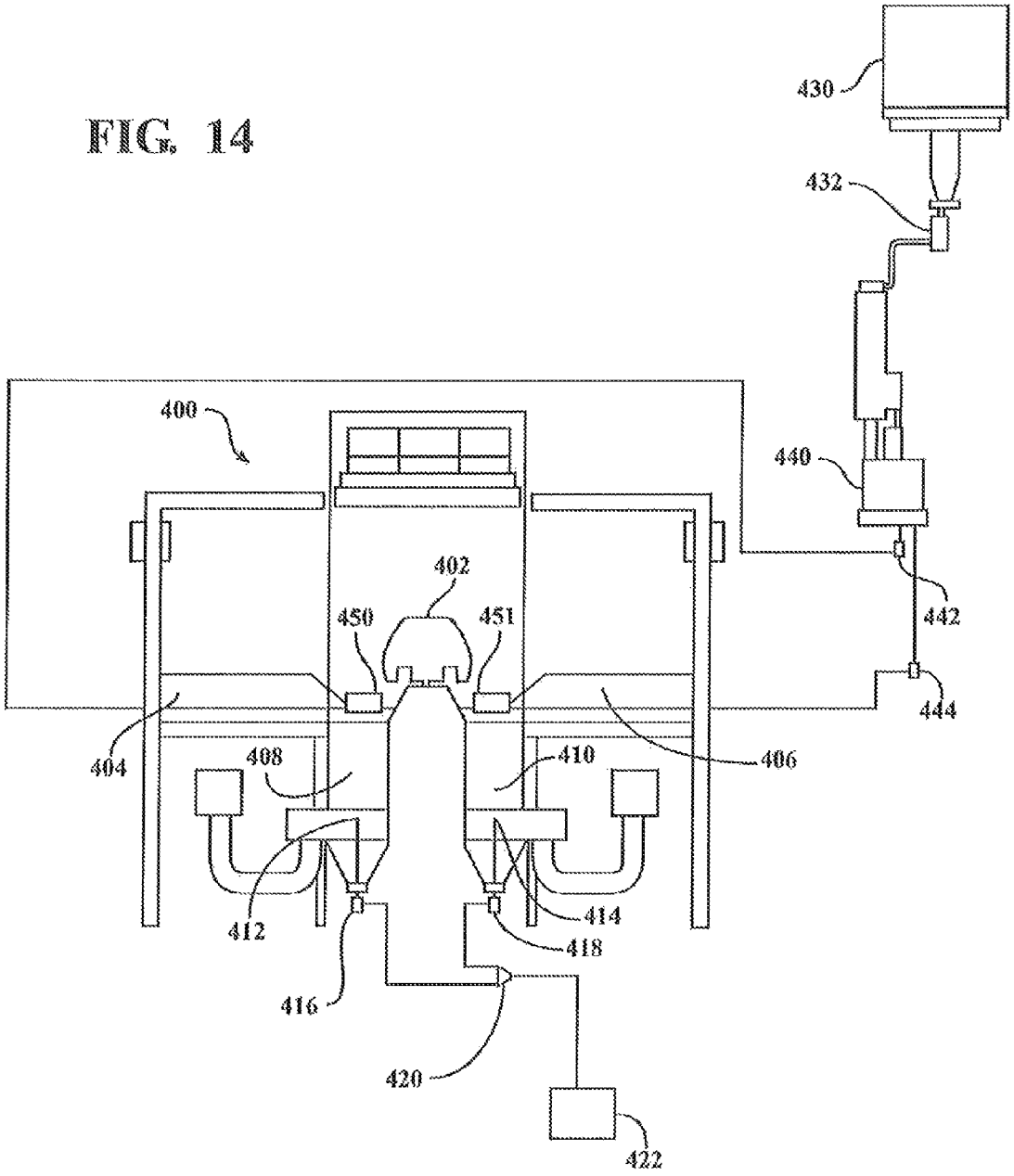
FIG. 14 is a schematic diagram of liquid paint spray apparatus using particulate lime collection trays for paint overspray collection.

Referring now to FIG. 14, there is depicted another aspect of the present invention which applies selected features described in the previous various powder delivery apparatus to a liquid paint spray system using a particular material that coagulates with the liquid paint particles, such as lime or domolit, as a paint overspray collection medium.

In a liquid paint spray application, such as the application of liquid spray paint in a spray booth 400 by one or more applicators, such as one more left side applicators and one or more right side applicators, overspray or liquid paint which does not adhere to the vehicle body 402 falls onto collector tray, such as a left side collector 404 and an identical right side collector 406 which are located on or below the paint booth 400 floor adjacent to the opposite lower sides of the vehicle body 402.

The liquid paint droplets fall onto the lime or domolit supplied to the collection trays 404 and 406 and coagulate and/or are captured by the solid lime or domolit particles. The coagulated particles of lime and liquid paint fall into chambers 408 and 410. Filters 412 and 414 are mounted in the lower portions of the chambers 408 and 410, respectively. The filters 412, 414 are back pulsed or vibrated to separate the dry lime particles from the coagulated paint lime droplets. The coagulated paint and lime particles are drawn off for disposal.

Transfer pumps 416 and 418 draw the paint lime particles from the filters 412 and 414, respectively. Pipes connected to the pumps 416 and 418 are merged in a two-way multi-directional valve 420. The output of the valve 420 is connected to a collection hopper 422.

As shown in FIG. 14, virgin lime is supplied to a bulk unload hopper 430. Virgin lime is transferred from the bulk onload hopper 430 by a transfer pump 432 to a delivery hopper 440. At least two transfer pumps 442 and 444 are connected to separate outlets of the hopper 440 to disperse virgin lime to the left side and right side collection trays 404 and 406.

A lime discharge drive 450 and 452 is associated with each collection tray 404 and 406, respectively. The drives 450 and 452 are movable along the longitudinal length of each collection tray 404 and 406, respectively, to disburse fresh lime particles from the conduits coupled to the transfer pumps 442 and 444.

The coagulated lime and paint particles are drawn forcibly through the filters 412 and 414 by a pressurized air stream. When a drop in air pressure is detected, the filters 412 and 414 are vibrated or back pulsed to allow the coagulated lime and paint particles to flow through the filters 412 and 414 and be drawn into the collection hopper 422.

What is claimed is:

1. An apparatus for paint powder transportation between a first location and an application point comprising:

a first powder hopper having a plurality of individual hopper outlets;

a first pair of transfer pumps, one of each of the first pair of transfer pumps coupled to a different one of the plurality of individual hopper outlets for transferring powder from the first powder hopper in separate powder flow paths;

a first pair of final dense phase pumps for transferring powder to two application location powder applicators;

a first cross-feed network formed of a plurality of multi-directional valves including a first pair of inlet valves coupled in paint powder flow to one of the first pair of transfer pumps, and a pair of outlet valves, each coupled in paint powder flow to one of the first pair of final dense phase pumps, each inlet valve having two outlets, each outlet separately and non-parallely coupled to one inlet of both of the pair of outlet valves, whereby control of the inlet and outlet valves allows powder to be transferred from the first powder hopper by either one of the first pair of transfer pumps through the first cross-feed network to either one of the first pair of final dense phase pumps.

2. The apparatus of claim 1 further comprising:

a second pair of transfer pumps, each coupled to one of a plurality of individual first hopper outlets; and the second pair of transfer pumps coupled to one of the multi-directional inlet valves of the first cross-feed network.

3. The apparatus of claim 1 wherein:

the first powder hopper is a virgin powder hopper.

4. The apparatus of claim 1 wherein:

the first powder hopper is a mix powder hopper containing virgin powder and reclaimed powder.

5. The apparatus of claim 1 further comprising:

the first powder hopper including a plurality of powder hoppers;

the first pair of transfer pumps including a plurality of transfer pumps coupled to outlets of each of a plurality of powder hoppers for transferring powder from each of the plurality of powder hoppers in separate flow paths;

the first cross-feed network includes a plurality of separate cross-feed powder networks fluidically coupled to the outlets of each of the plurality of powder hoppers, each of the plurality of cross-feed networks having a plurality of outlets; and multi-positional valves coupled to the outlets of each of the plurality of cross-feed network outlets for selectively delivering powder from each outlet of each of the plurality of powder hoppers to each of a plurality of powder application points.

6. An apparatus for paint powder transportation between a first location and an application paint comprising:

a first powder hopper having a plurality of individual hopper outlets;

a first pair of transfer pumps, one of each of the first pair of transfer pumps coupled to a different one of the plurality of individual hopper outlets for transferring powder from the first powder hopper in separate powder flow paths;

a first pair of final dense phase pumps for transferring powder to two application location powder applicators;

a first cross-feed network formed of a plurality of multi-directional valves including a first pair of inlet valves, each coupled to one of the first pair of transfer pumps, a pair of outlet valves, each coupled to one of the first pair of final dense phase pumps, each inlet valve having two outlets, each outlet coupled to one inlet of both of the pair of outlet valves, whereby control of the inlet and outlet valves allows powder to be transferred from the first powder hopper by either one of the first pair of transfer pumps through the first cross-feed network to either of the final dense phase pumps;

a second pair of transfer pumps, each coupled to one of a plurality of individual first hopper outlets;

the second pair of transfer pumps coupled to one of the multi-directional inlet valves of the first cross-feed network;

a second pair of final dense phase feed pumps, at the application location, and coupled to individual powder applicators; and separate outlets of the first cross-feed network coupled to multi-directional valves in turn coupled to each of the second pair of final dense phase pumps such that control of the multi-directional valve selects one of each of the second pair of final dense phase pumps to deliver powder to one applicator.

7. An apparatus for paint powder transportation between a first location and an application point comprising:

a first powder hopper having a plurality of individual hopper outlets;

a first pair of transfer pumps, one of each of the first pair of transfer pumps coupled to a different one of the plurality of individual hopper outlets for transferring powder from the first powder hopper in separate powder flow paths;

a first pair of final dense phase pumps for transferring powder to two application location powder applicators; and a first cross-feed network formed of a plurality of multi-directional valves including a first pair of inlet valves, each coupled to one of the first pair of transfer pumps, a pair of outlet valves, each coupled to one of the first pair of final dense pumps, each inlet valve having two outlets, each outlet coupled to one inlet of both of the pair of outlet valves, whereby control of the inlet and outlet valves allows powder to be transferred from the first powder hopper by either one of the first pair of transfer pumps through the first cross-feed network to either of the final dense pumps;

a second powder hopper;

a second pair of transfer pumps, one of the second pair of transfer pumps coupled to a different one of a plurality of individual second powder hopper outlets for transferring powder from the second powder hopper in separate powder flow paths;

a second pair of final dense phase pumps; and a second cross-feed network is formed of a plurality of multi-directional valves including a first pair of inlet valves, each coupled to one of the second pair of transfer pumps, a pair of outlet valves, each coupled to one of the second final feed dense phase pumps, each inlet valve having two outlets, each outlet coupled to one inlet of both outlet valves, whereby control of the inlet and outlet valves allows powder to be transferred from the second powder hopper by either of the first and second pairs of transfer pumps through the first and second cross-feed networks to either of the first and second final dense phase pumps.

8. The apparatus of claim 7 further comprising:

a first group of powder applicators;

a second group of powder applicators; and a plurality of multi-directional valves coupled between the outlets of the first and second cross-feed networks and the first and second groups of powder applicators to provide powder from each of the first and second hoppers to at least one applicator in each of the first and second groups of applicators.

9. The apparatus of claim 8 wherein:

each of the first and second groups of powder applicators includes at least three separate powder applicators.

10. The apparatus of claim 9 further comprising:

multi-directional valves coupled to the outlet of the outlet valves of each of the first and second cross-feed networks and to each of the at least three separate powder applicators in one of the first and second groups of powder applicators.

11. The apparatus of claim 10 further comprising:

each of the at least three separate powder applicators including at least one final feed dense phase pump.

12. The apparatus of claim 10 further comprising:

at least one of the at least three separate powder applicators including a pair of powder applicators; and multi-directional valves coupled to each of the pair of powder applicators to selectively control the transport of powder to either one of the first pair of final feed dense phase pumps.

13. The apparatus of claim 7 further comprising:

the first powder hopper containing virgin powder; and the second powder hopper containing a mixture of virgin powder and reclaimed powder.

14. The apparatus of claim 7 further comprising:

a third powder hopper;

a third pair of transfer pumps, each coupled to one of a plurality of individual third powder hopper outlets for transferring powder from the third powder hopper in separate flow paths;

a third pair of final dense phase pumps cross-feed; and the third cross-feed network formed of a plurality of multi-directional valves including a first pair of inlet valves, each coupled to one of the third pair of transfer pumps, and a pair of outlet valves, each coupled to one of the third pair of final feed dense phase pumps, each of the first pair of inlet valves having two outlets, each outlet coupled to one inlet of both of the pair of outlet valves, whereby control of first pair of the inlet valves and the pair of outlet valves allows powder to be transferred from the third powder hopper by one of the third pair of transfer pumps through the third cross-feed network to either of the third pair of final dense phase pumps.

* * * * *